US008727562B2

(12) United States Patent
Yu

(10) Patent No.: US 8,727,562 B2
(45) Date of Patent: May 20, 2014

(54) BACKLIGHT MODULE

(75) Inventor: Gang Yu, Guangdong (CN)

(73) Assignee: Shenzhen China Star Optoelectronics Technology Co., Ltd., Shenzhen, Guangdong Province (CN)

( * ) Notice: Subject to any disclaimer, the term of this patent is extended or adjusted under 35 U.S.C. 154(b) by 47 days.

(21) Appl. No.: 13/508,703

(22) PCT Filed: Mar. 19, 2012

(86) PCT No.: PCT/CN2012/072506
§ 371 (c)(1), (2), (4) Date: May 8, 2012

(87) PCT Pub. No.: WO2013/120298
PCT Pub. Date: Aug. 22, 2013

(65) Prior Publication Data
US 2013/0208503 A1 Aug. 15, 2013

(51) Int. Cl.
*F21V 29/00* (2006.01)

(52) U.S. Cl.
USPC ..... 362/218; 362/294; 362/612

(58) Field of Classification Search
USPC ..... 362/611, 612, 613, 294, 218, 373
See application file for complete search history.

(56) References Cited

U.S. PATENT DOCUMENTS

| | | | | |
|---|---|---|---|---|
| 7,600,910 | B2 * | 10/2009 | Sakai | 362/634 |
| 8,031,292 | B2 * | 10/2011 | Chun et al. | 349/65 |
| 2008/0232134 | A1 * | 9/2008 | Weng et al. | 362/612 |
| 2010/0073959 | A1 * | 3/2010 | Hamada | 362/611 |
| 2011/0170034 | A1 * | 7/2011 | Jeong | 349/61 |
| 2011/0170314 | A1 * | 7/2011 | Hsu et al. | 362/612 |
| 2011/0181809 | A1 * | 7/2011 | Sekiguchi et al. | 349/62 |
| 2012/0014135 | A1 | 1/2012 | Kim | |

* cited by examiner

*Primary Examiner* — Laura Tso
(74) *Attorney, Agent, or Firm* — Cheng-Ju Chiang

(57) ABSTRACT

The present invention provides a backlight module, which includes a backboard, a light bar mounted on the backboard, and a thermo-sensitive heat conduction material interposed between the backboard and the light bar. The thermo-sensitive heat conduction material functions to automatically adjust thermal conductivity coefficient with variation of temperature so that different portions of the light bar have different thermal conductivity coefficients in order to control the temperature of the whole light bar in a predetermined range to ensure desired performance of thermal conduction and further ensuring temperature uniformity of the whole backlight module and preventing the occurrence of luminance lowering of the whole backlight module due to excessive local high temperature.

6 Claims, 4 Drawing Sheets

BACKLIGHT MODULE

BACKGROUND OF THE INVENTION

1. Field of the Invention

The present invention relates to the technical field of liquid crystal displaying, and in particular to a backlight module that provides excellent thermal conductivity.

2. The Related Arts

Liquid crystal display (LCD) has a variety of advantages, such as compact device size, low power consumption, and being free of radiation, and is thus widely used. Most of the LCDs that are currently available in the market are backlighting LCDs, which comprise a liquid crystal panel and a backlight module. The working principle of the liquid crystal panel is that liquid crystal molecules interposed between two parallel glass plates and a plurality of vertical and horizontal fine electrical wires is arranged between the two glass plates, whereby the liquid crystal molecules are controlled to change direction by application of electricity to refract light emitting from the backlight module for generating images. Since the liquid crystal panel itself does not emit light, light must be provided by the backlight module in order to generate images. Thus, the backlight module is one of the key components of an LCD. The backlight module can be classified as two types, namely side-edge backlight module and direct backlight module, according to the position where light gets incident. The direct backlight module arranges a light source, such as a cold cathode fluorescent lamp (CCFL) or a light-emitting diode (LED) at the back side of the liquid crystal panel to form a planar light source to directly provide lighting to the liquid crystal panel. The side-edge backlight module arranged an LED light bar at an edge of a backboard that is located rearward of one side of the liquid crystal panel. The LED light bar emits light that enters a light guide plate through a light incident face of the light guide plate and is projected out through a light exit face after being reflected and diffused to thereby form a planar light source to be provided to the liquid crystal panel.

The conventional arrangements of heat dissipation for the LED backlight module often fix the light bar on a bracket and mount the bracket to the backboard. Fastening is often done with bolt or heat dissipative adhesive tapes, of which the former may easily cause air thermal resistance between the light bar and the bracket, leading to reduced heat dissipation performance, while the later has low coefficient of thermal conductivity, which severely affects the performance of heat dissipation. Further, the light bar shows relatively high temperature at a middle portion and relatively low temperatures at two opposite end portions during the operation thereof, and thus, special processing must be taken for the bracket in order to ensure the whole bracket shows temperature balance and to prevent occurrence of abnormal displaying of image due to localized excessive high temperature. However, this surely brings a consequence of increasing processing cost.

To handle such a problem, Chinese Patent No. 201120142696.3 discloses an LED backlight source and a liquid crystal panel (as shown in FIG. 1). The LED backlight source comprise a backboard 1, heat conduction blocks 2 mounted to the backboard 1, and LED light bars 3 mounted on the heat conduction blocks 2. The LED backlight source also comprises a heat pipe 3. The heat pipe 3 has a high temperature end that is set in contact with the heat conduction block 2. A low temperature end of the heat pipe 3 is set at a location distant from the LED light bars 4 and is in contact with the backboard 1. As such, the temperature is made uniform through the whole backboard and the life span of the LED light bars is extended. However, such a technical solution increases the cost of the LED backlight module to quite an extent and the number of structural components is great, making the assembling tedious and defect rate of assembling increased.

SUMMARY OF THE INVENTION

An objective of the present invention is to provide a backlight module, which uses thermo-sensitive heat conduction material to automatically adjust thermal conductivity so as to facilitate control of temperature of light bars within a predetermined range thereby ensuring temperature uniformity of backboard.

To achieve the objective, the present invention provides a backlight module, which comprises: a backboard, a light bar mounted on the backboard, and a thermo-sensitive heat conduction material interposed between the backboard and the light bar.

The thermo-sensitive heat conduction material comprises a negative coefficient thermo-sensitive heat conduction material, which has thermal conductivity coefficient that decreases in exponential form with increase of temperature.

The backboard comprises a bottom plate and a side plate connected to the bottom plate. The side plate and the bottom plate define an accommodation space. The light bar and the thermo-sensitive heat conduction material are accommodated in the accommodation space.

The light bar is mounted to the side plate of the backboard, and the thermo-sensitive heat conduction material is arranged between the light bar and the side plate.

The backboard comprises a bracket arranged in the accommodation space. The light bar is mounted on the bracket. The bracket is mounted to the side plate of the backboard. The thermo-sensitive heat conduction material is interposed between the light bar and the bracket.

Further included is a reflection plate that is accommodated in the accommodation space, a light guide board that is arranged on the reflection plate, and an optic component that is mounted on the light guide board. The reflection plate is mounted on the bottom plate of the backboard.

The light bar comprises a linear LED light bar.

The efficacy of the present invention is that the present invention provides a backlight module, which comprises a thermo-sensitive heat conduction material interposed between a light bar and a backboard or between the light bar and a bracket. The thermo-sensitive heat conduction material functions to automatically adjust thermal conductivity coefficient with variation of temperature so that different thermal conductivity coefficients are realized at different sites of the light bar in order to control the temperature of the whole light bar in a predetermined range to ensure desired performance of thermal conduction and further ensuring temperature uniformity of the whole backlight module and preventing the occurrence of luminance lowering of the whole backlight module due to excessive local high temperature. Further, the filling of the thermo-sensitive heat conduction material make the contact engagement between the light bar and the backboard or between the light bar and the bracket more tight thereby eliminating the need of special processing of the bracket that is required in the prior art so that the cost can be reduced.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, will be apparent from the following detailed description of embodiments of the present invention, with reference to the attached drawings. In the drawings.

DETAILED DESCRIPTION OF THE PREFERRED EMBODIMENTS

To further expound the technical solution adopted in the present invention and the advantages thereof, a detailed description is given to preferred embodiments of the present invention and the attached drawings.

Figure 1:
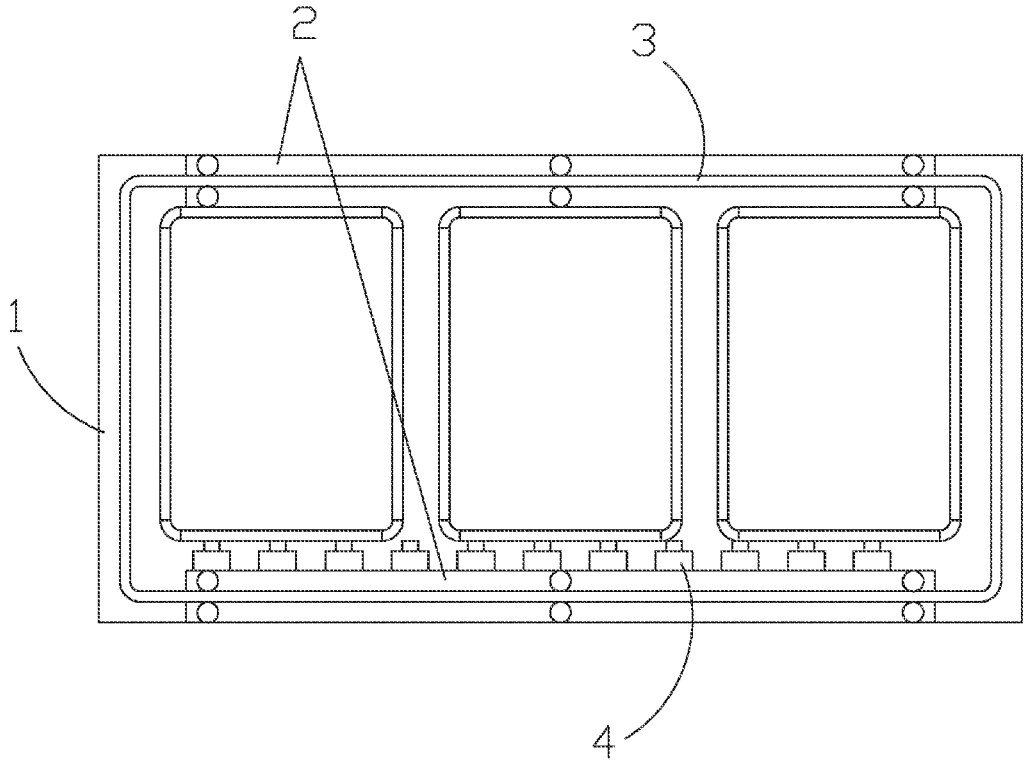
Fig. 1 (Prior Art)
FIG. 1 is a schematic view showing a conventional LED backlight module.
Figure 2:
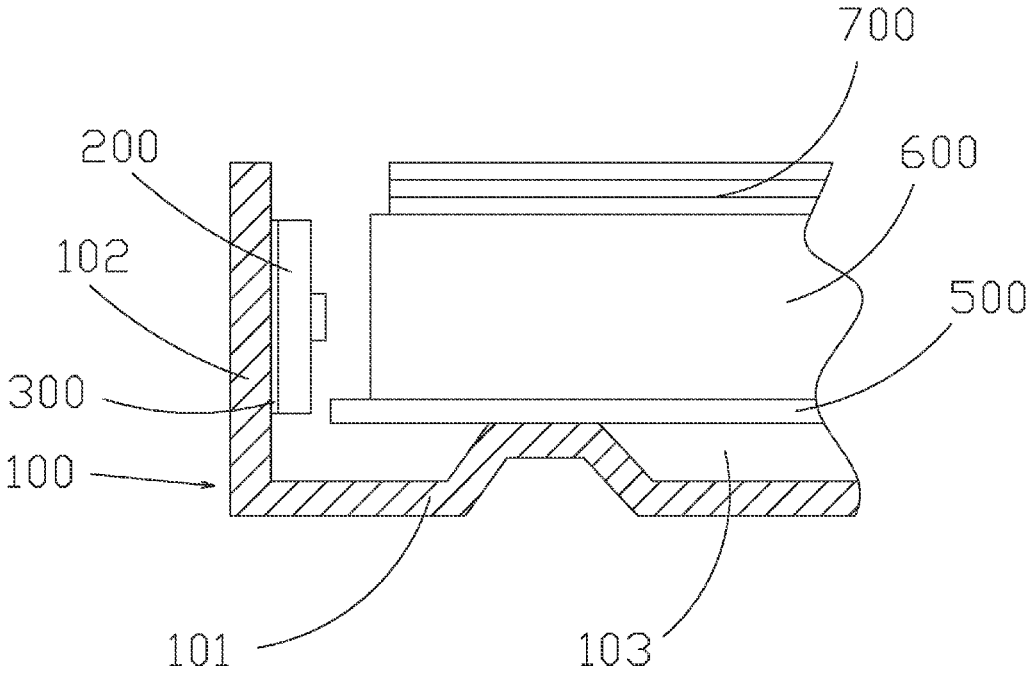
FIG. 2 is a schematic view showing a backlight module according to an embodiment of the present invention.
Figure 3:
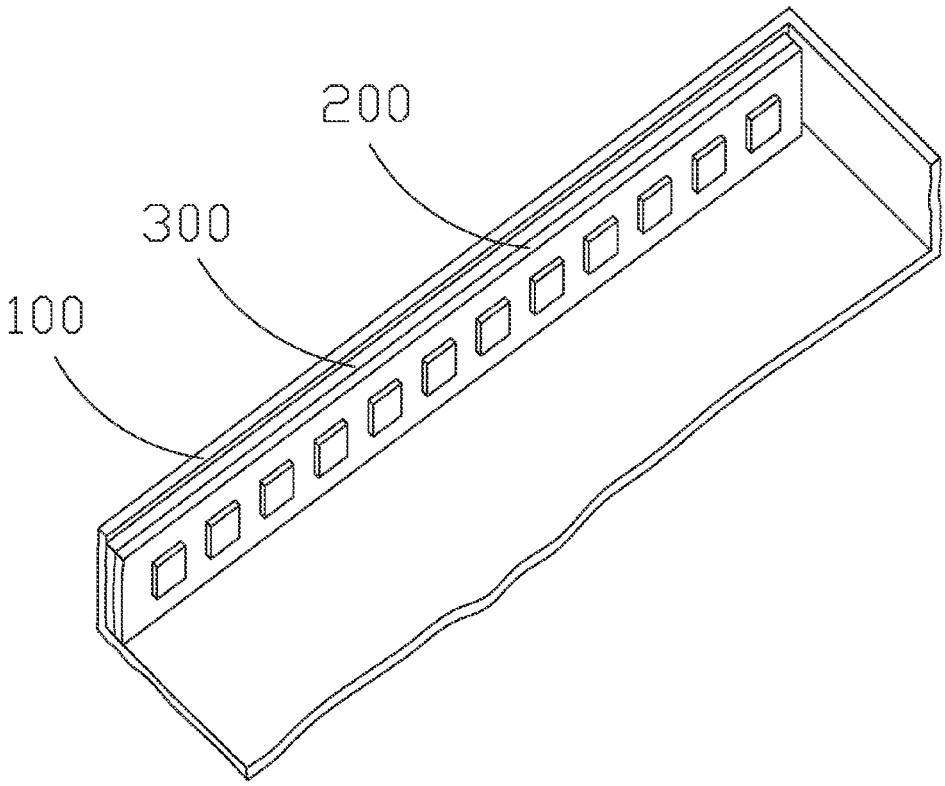
FIG. 3 is a perspective view showing a backboard and light bar of FIG. 2.

With reference to FIGS. 2 and 3, schematic views are given to show a backlight module according to an embodiment of the present invention. The backlight module of the present invention comprises: a backboard 100, a light bar 200 mounted inside the backboard 100, a thermo-sensitive heat conduction material 300 arranged between the backboard 100 and the light bar 200, a reflection plate 500 mounted inside the backboard 100, a light guide board 600 arranged on the reflection plate 500, and optic components 700 arranged on the light guide board 600. The light bar 200 emits light that transmits, directly or after being reflected by the reflection plate 500, into the light guide board 600 to thereby provide a planar light source of homogeneous brightness for the optic components 700.

The backboard 100 comprises a bottom plate 101 and a side plate 102 connected to the bottom plate 101. The bottom plate 101 and the side plate 102 collectively define an accommodation space 103. The light bar 200, the reflection plate 500, the light guide board 600, and the optic components 700 are accommodated in the accommodation space 103. The light bar 200 can be a linear LED light bar. The light bar 200 is mounted to the side plate 102 of the backboard 100, the reflection plate 500 is mounted on the bottom plate 101, the light guide board 600 is arranged on the reflection plate 500, and the optic components 700 are arranged on the light guide board 600 so as to construct a side-edge backlight module.

Preferably, the light bar 200 is directly mounted to the side plate 102 of the backboard 100 and the thermo-sensitive heat conduction material 300 is interposed between the side plate 102 of the backboard 100 and the light bar 200. The thermo-sensitive heat conduction material 300 is a negative coefficient thermo-sensitive heat conduction material, and the thermal conductivity coefficient of the thermo-sensitive heat conduction material 300 is reduced in an exponential manner with the increase of temperature. When different portions of the light bar 200 are of different temperatures (relatively high or relatively low), the portions of the thermo-sensitive heat conduction material 300 corresponding to those portions of the light bar show correspondingly different thermal conductivity coefficients. When the portions have relatively high temperature, the corresponding portions of the thermo-sensitive heat conduction material 300 show correspondingly reduced thermal conductivity coefficients to thereby enhance thermal conductivity of these portions; when the portions have relatively low temperature, the corresponding portions of the thermo-sensitive heat conduction material 300 show correspondingly increased thermal conductivity coefficients to thereby reduce thermal conductivity of these portions, so that the temperature of the light bar 200 is controlled within a predetermined range, ensuring temperature uniformity of the whole backlight module and preventing the occurrence of luminance lowering of the whole backlight module due to excessively local high temperature.

Figure 4:
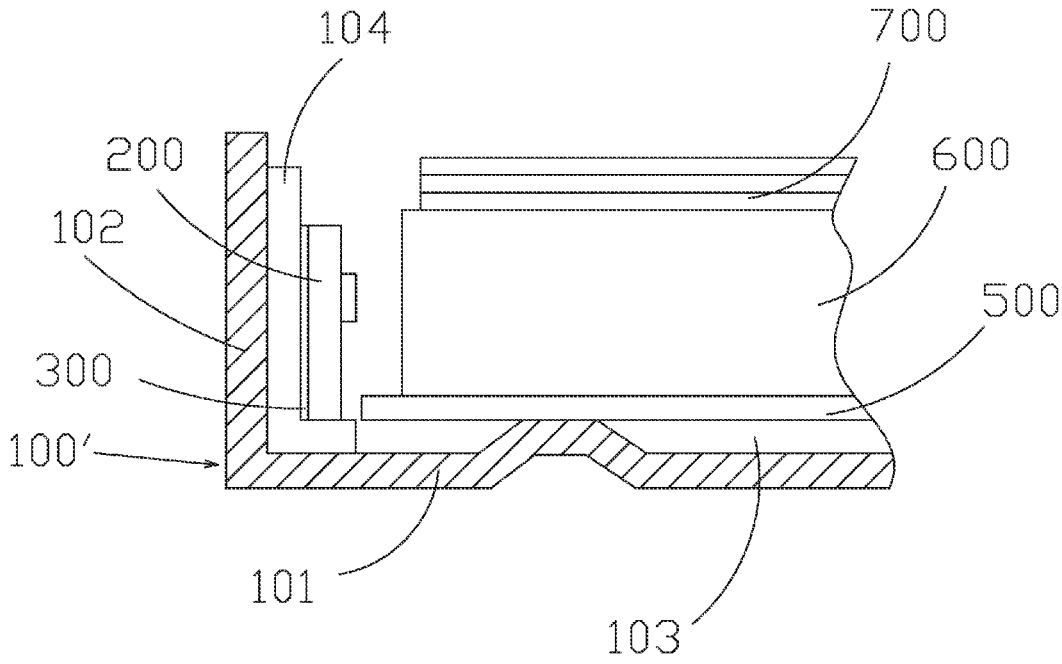
FIG. 4 is a schematic view showing a backlight module according to another embodiment of the present invention.

Referring to FIG. 4, a schematic view is given to show a backlight module according to another embodiment of the present invention. In the instant embodiment, the backlight module comprises a backboard 100' that comprises a bracket 104. A light bar 200 is mounted on the bracket 104 and a thermo-sensitive heat conduction material 300 is arranged between the bracket 104 and the light bar 200. The bracket is made of a metal having excellent thermal conductivity, such as aluminum, in order to help adjusting temperature uniformity of the whole backlight module. Similarly, when different portions of the light bar 200 are of different temperatures (relatively high or relatively low), the portions of the thermo-sensitive heat conduction material 300 corresponding to those portions of the light bar show correspondingly different thermal conductivity coefficients. When the portions have relatively high temperature, the corresponding portions of the thermo-sensitive heat conduction material 300 show correspondingly reduced thermal conductivity coefficients to thereby enhance thermal conductivity of these portions; when the portions have relatively low temperature, the corresponding portions of the thermo-sensitive heat conduction material 300 show correspondingly increased thermal conductivity coefficients to thereby reduce thermal conductivity of these portions, so that the temperature of the light bar 200 is controlled within a predetermined range, ensuring temperature uniformity of the whole backlight module and preventing the occurrence of luminance lowering of the whole backlight module due to excessive local high temperature.

In summary, the present invention provides a backlight module that comprise a thermo-sensitive heat conduction material interposed between a light bar and a backboard or between a light bar and a bracket and the thermo-sensitive heat conduction material functions to automatically adjust the thermal conductivity coefficient with the variation of temperature so that different thermal conductivity coefficients are realized at different sites of the light bar and the temperature of the whole light bar can be controlled within a predetermined range to ensure desired performance of thermal conduction and further ensuring temperature uniformity of the whole backlight module and preventing the occurrence of luminance lowering of the whole backlight module due to excessive local high temperature. Further, the filling of the thermo-sensitive heat conduction material make the contact engagement between the light bar and the backboard or between the light bar and the bracket more tight thereby eliminating the need of special processing of the bracket that is required in the prior art so that the cost can be reduced.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A backlight module, comprising: a backboard, a light bar mounted on the backboard, and a thermo-sensitive heat conduction material interposed between the backboard and the light bar, wherein the thermo-sensitive heat conduction material comprises a negative coefficient thermo-sensitive heat conduction material, which has thermal conductivity coefficient that decreases in exponential form with increase of temperature.

2. The backlight module as claimed in claim 1, wherein the backboard comprises a bottom plate and a side plate connected to the bottom plate, the side plate and the bottom plate defining an accommodation space, the light bar and the thermo-sensitive heat conduction material being accommodated in the accommodation space.

3. The backlight module as claimed in claim 2, wherein the light bar is mounted to the side plate of the backboard, the thermo-sensitive heat conduction material being arranged between the light bar and the side plate.

4. The backlight module as claimed in claim 2, wherein the backboard comprises a bracket arranged in the accommodation space, the light bar being mounted on the bracket, the bracket being mounted to the side plate of the backboard, the thermo-sensitive heat conduction material being interposed between the light bar and the bracket.

5. The backlight module as claimed in claim 2, further comprising a reflection plate accommodated in the accommodation space, a light guide board arranged on the reflection plate, and an optic component mounted on the light guide board, the reflection plate being mounted on the bottom plate of the backboard.

6. The backlight module as claimed in claim 1, wherein the light bar comprises a linear light emitting diode (LED) light bar.

* * * * *